US008439339B2

(12) United States Patent
Roesch et al.

(10) Patent No.: US 8,439,339 B2
(45) Date of Patent: May 14, 2013

(54) CLAMP

(75) Inventors: Hans Roesch, Gemmrigheim (DE); Michael Moesslein, Leonberg (DE); Rainer Steinle, Denkendorf (DE); Michael Duss, Bietigheim-Bissingen (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 1076 days.

(21) Appl. No.: 12/009,643

(22) Filed: Jan. 17, 2008

(65) Prior Publication Data

US 2009/0025192 A1 Jan. 29, 2009

(30) Foreign Application Priority Data

Jul. 26, 2007 (EP) ..... 000764972
Dec. 13, 2007 (DE) ..... 10 2007 062 278

(51) Int. Cl.

| | |
|---|---|
| ***B25B 1/10*** | (2006.01) |
| ***B25B 5/10*** | (2006.01) |
| ***B25B 5/00*** | (2006.01) |
| ***B25B 1/00*** | (2006.01) |
| ***B25B 1/02*** | (2006.01) |
| ***B25B 5/02*** | (2006.01) |
| ***B43L 5/00*** | (2006.01) |
| *B25B 5/06* | (2006.01) |

(52) U.S. Cl.
USPC ..... 269/249; 269/6; 269/88; 269/170; D8/72

(58) Field of Classification Search ..... 269/249, 269/6, 88, 203, 170; D8/72
See application file for complete search history.

(56) References Cited

U.S. PATENT DOCUMENTS

| | | | | | |
|---|---|---|---|---|---|
| 140,747 | A | * | 7/1873 | Walker | 269/215 |
| D24,757 | S | | 10/1895 | Howard | |
| D25,087 | S | | 1/1896 | Willson | |
| D28,085 | S | | 12/1897 | Sandstrom | |
| 640,500 | A | * | 1/1900 | Taylor | 269/171.5 |
| 1,741,923 | A | * | 12/1929 | Dohnal | 269/171.5 |
| D134,792 | S | * | 1/1943 | Beil | D25/121 |
| 2,644,498 | A | * | 7/1953 | Malecki | 269/182 |

(Continued)

FOREIGN PATENT DOCUMENTS

| | | |
|---|---|---|
| DE | 946 790 | 8/1956 |
| DE | 42 36 049 | 4/1994 |

(Continued)

OTHER PUBLICATIONS

BESSEY—Spanntechnik—Handwerkzeuge, Schere, ERDI, ERDI Schere, Spanntech . . . , [online], [retrieved on Mar. 7, 2007], Retrieved from the BESSEY Tool GmbH & Co. KG website using Internet < URL: http://www.bessey.de/catalogue/catalogue.do?id=357&favOid=000000000002dea000....com >.

(Continued)

*Primary Examiner* — Lee D Wilson
*Assistant Examiner* — Alvin Grant
(74) *Attorney, Agent, or Firm* — Lipsitz & McAllister, LLC

(57) ABSTRACT

A clamp comprising a slide rail, a fixed arm integrally joined to the slide rail, and a slide arm movable on the slide rail is provided, the slide rail having in the cross section an overall height and an overall width having a ratio to each other, which ranges between 2.55:1 and 2.8:1.

30 Claims, 3 Drawing Sheets

U.S. PATENT DOCUMENTS

| | | | | |
|---|---|---|---|---|
| 2,815,778 | A | 12/1957 | Holman | |
| D193,736 | S | 10/1962 | Yandt | |
| D219,877 | S | 2/1971 | Thompson | |
| D221,730 | S | 9/1971 | Marietta | |
| 3,668,765 | A | 6/1972 | Clark | |
| 3,914,830 | A * | 10/1975 | Bolton | 24/490 |
| 3,933,346 | A * | 1/1976 | Carver | 269/4 |
| 4,042,264 | A * | 8/1977 | Shumer | 269/88 |
| 4,183,513 | A * | 1/1980 | Enz | 269/203 |
| D272,711 | S | 2/1984 | Griset | |
| D285,170 | S | 8/1986 | Knight et al. | |
| D296,575 | S | 7/1988 | McNeil | |
| 4,758,110 | A | 7/1988 | Ito | |
| D331,188 | S | 11/1992 | Stolk | |
| 5,405,124 | A * | 4/1995 | Mayer et al. | 269/45 |
| 5,427,364 | A * | 6/1995 | Zborschil | 269/166 |
| D364,081 | S | 11/1995 | Yates et al. | |
| D406,094 | S | 2/1999 | Lai | |
| 6,113,085 | A * | 9/2000 | Lindenthal et al. | 269/6 |
| 6,113,089 | A * | 9/2000 | Kleinbongartz | 269/166 |
| 6,123,326 | A * | 9/2000 | Kleinbongartz | 269/215 |
| 6,367,790 | B2 * | 4/2002 | Ocklenburg et al. | 269/166 |
| D467,152 | S * | 12/2002 | Wolff | D8/72 |
| D473,661 | S | 4/2003 | Kim | |
| D478,271 | S | 8/2003 | McCoy et al. | |
| 6,848,683 | B2 * | 2/2005 | Foshag et al. | 269/3 |
| 7,093,828 | B2 * | 8/2006 | Murray et al. | 269/6 |
| D541,953 | S | 5/2007 | Deleu | |
| D543,821 | S | 6/2007 | Ranieri | |
| D545,161 | S * | 6/2007 | Ranieri | D8/72 |
| D549,063 | S | 8/2007 | Pribyl et al. | |
| D576,850 | S | 9/2008 | Lee et al. | |
| D593,277 | S | 6/2009 | Wylie | |
| D612,715 | S * | 3/2010 | Weinberg et al. | D8/394 |
| 7,798,478 | B2 * | 9/2010 | Janson et al. | 269/6 |
| 2001/0011792 | A1 | 8/2001 | Ocklenburg et al. | |
| 2009/0025192 | A1 * | 1/2009 | Roesch et al. | 24/525 |
| 2009/0026681 | A1 * | 1/2009 | Kloepfer et al. | 269/147 |
| 2009/0187118 | A1 | 7/2009 | Kim et al. | |
| 2010/0156015 | A1 * | 6/2010 | Klein et al. | 269/166 |

FOREIGN PATENT DOCUMENTS

| | | |
|---|---|---|
| DE | 100 05 350 | 8/2001 |
| EP | 0 070 400 | 1/1983 |
| FR | 1 070 193 | 7/1954 |
| JP | 53-4398 | 6/1951 |
| JP | 63-193657 | 12/1988 |
| JP | 1-79563 | 5/1989 |
| JP | 4-54669 | 5/1992 |
| JP | 6210573 | 8/1994 |
| JP | 3007509 | 2/1995 |
| JP | 3120369 | 3/2006 |
| TW | 279095 | 6/1996 |

OTHER PUBLICATIONS

Web page printout of Bessey catalog, Bessey screw clamps "LM", one page, Jul. 3, 2007, <URL:http://www.bessey.de/catalogue/catalogue.do?id=357&favOid=000000000002dea000 . . . >.

Web page printout of Bessey catalog, Bessey all-steel screw clamps "GZ", one page, Jul. 1, 2007 <URL:http://www.bessey.de/catalogue/catlogue.do?id=317&favOid=00 . . . >.

Patent Abstracts of Japan, Publication No. 59183507, "Microwave Oscillator", application No. 58057865, Apr. 4, 1983.

* cited by examiner

CLAMP

The present disclosure relates to the subject matter disclosed in EU design registration number 000764972 of Jul. 26, 2007 and German patent application number 10 2007 062 278.5 of Dec. 13, 2007, which are incorporated herein by reference in their entirety and for all purposes.

BACKGROUND OF THE INVENTION

The invention relates to a clamp comprising a slide rail, a fixed arm integrally joined to the slide rail, and a slide arm movable on the slide rail.

BESSEY Tool GmbH & Co. KG sells screw clamps under the designation LM. These have a slide rail and a fixed arm. The fixed arm is a component which is separate from the slide rail and is held on the slide rail by being pressed onto it.

BESSEY Tool GmbH & Co. KG also sells all-steel screw clamps under the designation GZ with a one-piece combination of slide arm, fixed arm and pressure plate, which is manufactured by hot forming.

A screw clamp with a clamping spindle arranged in the movable lower transverse arm, and an upper transverse arm forming with the running rail one piece is known from DE 946 790. The running rail and the transverse arm consist of steel and have a rectangular cross section with a ratio of height to width of less than 2.5. It is also described in this publication that there are screw clamps in which the ratio of the width of the running rail to the cross-sectional height is 1:3, and that running rails made of steel are also known, in which this ratio is 1:3.5 or 1:4.

SUMMARY OF THE INVENTION

In accordance with the present invention, a clamp is provided, which has advantageous characteristics.

In accordance with an embodiment of the invention, the slide rail has in the cross section an overall or total height and an overall or total width having a ratio to each other, which ranges between 2.55:1 and 2.8:1.

With the solution according to the invention, a clamp such as, for example, a screw clamp is provided, wherein a high lateral rigidity of the slide rail is achieved with optimum exploitation of the material in the manufacture of the slide rail, a strong sagging of the slide rail is avoided, and a flat decline in the clamping force is achieved in the case of yielding workpieces.

It has been found that in slide rails in which the ratio is between 3:1 and 4:1, a high overall rigidity is achieved, but the lateral rigidity is relatively low and the decline in the clamping force is sharp in the case of yielding workpieces.

In the case of slide rails in which the ratio is between 2:1 and 2.2:1, a high lateral rigidity is obtained and a flat decline in the clamping force in the case of yielding workpieces, but too strong a sagging of the slide rail may result in too strongly an inclined position of a slide arm and hence of a spindle held on the slide arm. This increases the friction and, therefore, reduces the achievable clamping force. Moreover, a strongly inclined position of this spindle enhances the sagging of the slide rail even further, i.e., reinforces it, as the lever acting thereon is extended. Furthermore, the tendency for a pressure plate to lift off is increased, and the clamp may possibly slip off. In addition, the exploitation of the material is not optimal, as with such a ratio the lateral rigidity is, as a rule, higher than required.

In the solution according to the invention, the ratio is between 2.55:1 (inclusive) and 2.8:1 (inclusive). The advantages of the prior art clamps are thereby achieved (the advantages being combined), and the disadvantages are avoided or the disadvantages are reduced to a considerable extent.

Furthermore, in spite of a larger height, the ratio according to the invention results in a bending stress below the admissible values under the loads that occur.

The handling is simplified as the profile is wider. As a result, the slide rail does not rotate so easily in one's hand when it is being held.

Furthermore, with the ratio according to the invention, a bending can also be carried out to produce the fixed arm on the slide rail with smallest possible inner radius, without any buckling occurring. The bending can be carried out through an angle of 90° or more.

The slide rail can be manufactured from an endless band material in its profile together with the fixed arm by cold forming such as cold drawing or cold rolling. The cold-formed material has increased strength values. If the slide rail and the fixed arm are integrally joined, such a combination can be produced in a simple way by bending.

In particular, it is favorable for the ratio of overall height to overall width to be at least 2.6:1.

It is favorable for the slide rail to have a constant profile cross section throughout its length. The advantages described hereinabove are thereby achieved throughout the entire length of the slide rail.

For the same reason, it is favorable for the fixed arm to have, at least at an area of transition to the slide rail, the same profile as the slide rail.

The ratio of overall height to overall width refers to the maximum height and the maximum width of the slide rail in the cross section.

In particular, the maximum width and the maximum height are defined by enveloping planes of the slide rail.

It is quite particularly advantageous for the slide rail to be of mirror-symmetrical configuration in the cross section. This results in symmetrical force relations with simple manufacturability of the slide rail.

In particular, the slide rail has a first mirror plane, and a second mirror plane lying vertically thereto. As a result, a high symmetry is achieved, and the slide rail can, therefore, be manufactured in a simple way.

In particular, enveloping planes of the slide rail form a rectangle in the cross section. This results in an optimized flow of forces with simple manufacturability.

It is quite particularly advantageous for the slide rail to be waisted in the cross section. With an optimized distribution of forces, this results in an optimized exploitation of the material in the manufacture of the slide rail.

In an embodiment, the slide rail has a first region, at which the slide rail has a maximum width in the cross section, a second region which follows the first region, and a third region which follows the second region and which is a waist region, and in which the slide rail has a minimum width in the cross section, the second region being an intermediate region whose width is between the maximum width and the minimum width. A waisted configuration can thereby be formed in a simple way. A transition from a region of maximum width to a region of minimum width can be achieved in a simple way.

It is favorable for a waist region of the slide rail to have a substantially planar surface. This surface can then be printed on in a simple way in order to record product data and the like.

It is quite particularly advantageous for the slide rail to be rounded-off at edges. As a result, force peaks and tension peaks are avoided. Furthermore, the risk of injury is reduced. The manufacture is facilitated.

In an advantageous embodiment, an enveloping surface of the slide rail at an outer side and/or an inner side is a cylinder. As a result, the slide rail is rounded-off at the corresponding side. It can, therefore, be manufactured in a simple way by profile drawing or the like.

It is then favorable for a radius of the cylinder to be the overall height. As a result, the slide rail can be manufactured in a simple way.

In an embodiment, the slide rail has a hollow on both an outer side and an inner side. This hollow facilitates manufacture of the slide rail.

It is quite particularly advantageous for a region of the slide rail in which it has the maximum width in the cross section, to take up at most 50% of the overall height of the slide rail in the cross section. As a result, an optimized exploitation of the material with an optimized flow of forces and flow of tension on the slide rail is achieved.

It is also favorable for a minimum width of the slide rail to be between 65% and 85% of the overall width of the slide rail. Optimized results with respect to use of the slide rail, accompanied by simple manufacturability and optimized exploitation of the material for the manufacture, are thereby achieved. In particular, a high transverse rigidity is obtained, with the sagging capability of the slide rail being relatively low and a sufficient torsional rigidity being guaranteed.

It can be provided that at least one abutment element is formed on the fixed arm. This abutment element is formed directly thereon and provides one or more abutment surfaces for a workpiece. The forming can be carried out by hot forming or cold forming.

In an alternative embodiment, a pressure plate is arranged on the fixed arm, the pressure plate being a separate part from the fixed arm and being fixed with positive locking and/or with force locking on the fixed arm. In principle, an undesired change in the microstructure with impairment of the strength values occurs when, for the purpose of deformation of the material, heating is carried out on a part produced by cold forming. In order to avoid such a change in the microstructure, the pressure plate, which acts on a workpiece, is subsequently arranged on the fixed arm and, therefore, not manufactured integrally with the fixed arm. As a result, no heating of the fixed arm and the slide rail is required, and, therefore, no change in the microstructure with loss of strength occurs. While clamping one or more workpieces, the pressure plate is essentially only subjected to a compressive force. The fixed arm is subjected to the stronger force load and, in particular, also to tensile forces and bending forces. The integral fixing of the fixed arm on the slide rail results in a high stability with an optimized flow of forces. Such a clamp can be manufactured in a simple and cost-effective way.

In an embodiment, the pressure plate is fixed by being pressed onto the fixed arm. A simple fixability with reliable retention of the pressure plate is thereby achieved.

It is, for example, also possible for the pressure plate to be fixed, in particular, with positive locking, on the fixed arm by snap-in locking or by securing with pins or screws or by injection molding.

It is quite particularly advantageous for the pressure plate to be fixed to the fixed arm by a process which does not require any heating of the fixed arm that brings about a change in the microstructure. As a result, the clamp according to the invention can be manufactured in a simple way.

It is favorable for the fixed arm to be produced on the slide rail by bending. From a corresponding (and, in particular, already profiled) preliminary element, the fixed arm, which is orientated in curved configuration transversely to the slide rail, can then be produced in a bending machine. A subsequent fixing of a separately produced fixed arm on the slide rail is then no longer necessary.

In an embodiment, the fixed arm has a convexly curved outer side and a concavely curved inner side. Such a fixed arm can be produced in a simple way on a profiled rail, with the slide rail, which is substantially straight, and the fixed arm, which is curved, being formed on the profiled rail.

In particular, the outer side and the inner side are parallel to each other. This results in simple manufacturability. Such a combination of side rail and fixed arm can be manufactured from a straight rail, which is produced by cold forming and has a corresponding profile.

It is also favorable for the convexly curved outer side of the fixed arm to pass tangentially into the slide rail and for the concavely curved inner side to pass tangentially into the slide rail. A "smooth" transition without corners or edges is thereby obtained. This, in turn, enables an optimized flow of forces.

In an embodiment, the fixed arm has at least one region having the shape of a (circular) ring segment. As a result, the fixed arm can be produced in a simple way by bending on a bending machine.

In particular, the slide rail is straight. As a result, the slide arm can be guided on the slide rail.

It is favorable for the combination of slide rail and fixed arm to be manufactured by cold forming. For example, the corresponding profiled bar, on which the fixed arm is then later produced by, for example, bending, is manufactured by cold rolling or cold drawing an endless band (such as, for example, a steel band).

In particular, a first enveloping plane of the slide rail and an enveloping plane of the fixed arm coincide. Furthermore, in particular, a second enveloping plane of the slide rail and a corresponding enveloping plane of the fixed arm coincide. The fixed arm can be produced on the slide rail by flat bending.

In particular, there is seated on the slide arm a clamping device, which is directed with a counter pressure plate towards the pressure plate on the fixed arm. As a result, one or more workpieces can be clamped between the pressure plate and the counter pressure plate.

It is then also favorable for the pressure plate and the counter pressure plate to have substantially parallel abutment surfaces for a workpiece so as to enable a defined clamping.

Provision is made in an embodiment for the clamping device to comprise (at least) one clamping screw, which is guided on a thread of the slide arm. By tilting the slide arm on the slide rail, the slide arm can be fixed while one or more workpieces are being clamped between the pressure plate and the counter pressure plate. A corresponding clamping force can be exerted by the clamping screw. Other configurations of the clamping device such as, for example, eccentric clamp or lever clamp are also possible.

In particular, an axis of rotation of the clamping screw impinges on the pressure plate. As a result, a force can be specifically exerted with a direction of force, which is coaxial with the direction of rotation.

It is favorable for the pressure plate to comprise an abutment region with an abutment surface for a workpiece, and a fixing region for fixing to the fixed arm. The joining of the pressure plate to the fixed arm is effected via the fixing region. The abutment region provides the abutment surface for the workpiece.

The pressure plate is, for example, cap-shaped and has a receiving space for a fixed arm region. Via the receiving space, the pressure plate can be placed on the fixed arm and, for example, pressed onto the latter so as to retain the pressure plate with form locking and/or force locking at the fixing region. A correspondingly large "inner" abutment surface for a press fit of the pressure plate at the fixing region is provided.

It is also possible for the pressure plate to be held solely via the fixing region or additionally via positively locking elements such as screws or the like. Other possibilities for the fixing with positive locking such as, for example, snap-in locking or securing with pins are also feasible.

In an embodiment, the pressure plate has an abutment region which extends into the vicinity of the slide rail or as far as the slide rail or into a region of the fixed arm in the vicinity of the slide rail. An enlarged abutment region is thereby provided. As the pressure plate is separate from the fixing region, the abutment surface of the pressure plate does not have to follow the shape of the fixed arm. This can be used to enlarge the abutment surface.

A corresponding clamp is disclosed in German patent application No. 10 2007 032 146.7 of Jul. 4, 2007, not previously published, of the same applicant. Reference is made explicitly to this application.

In an embodiment, the abutment region is fixed to the slide rail or to the region of the fixed arm in the vicinity of the slide rail. The stability is thereby increased.

In particular, the fixing is with positive locking and/or force locking, so that the fixing does not require any heating that would change the microstructure (and hence reduce the strength).

The following description of preferred embodiments serves to explain the invention in greater detail in conjunction with the drawings.

DETAILED DESCRIPTION OF THE INVENTION

Figure 1:
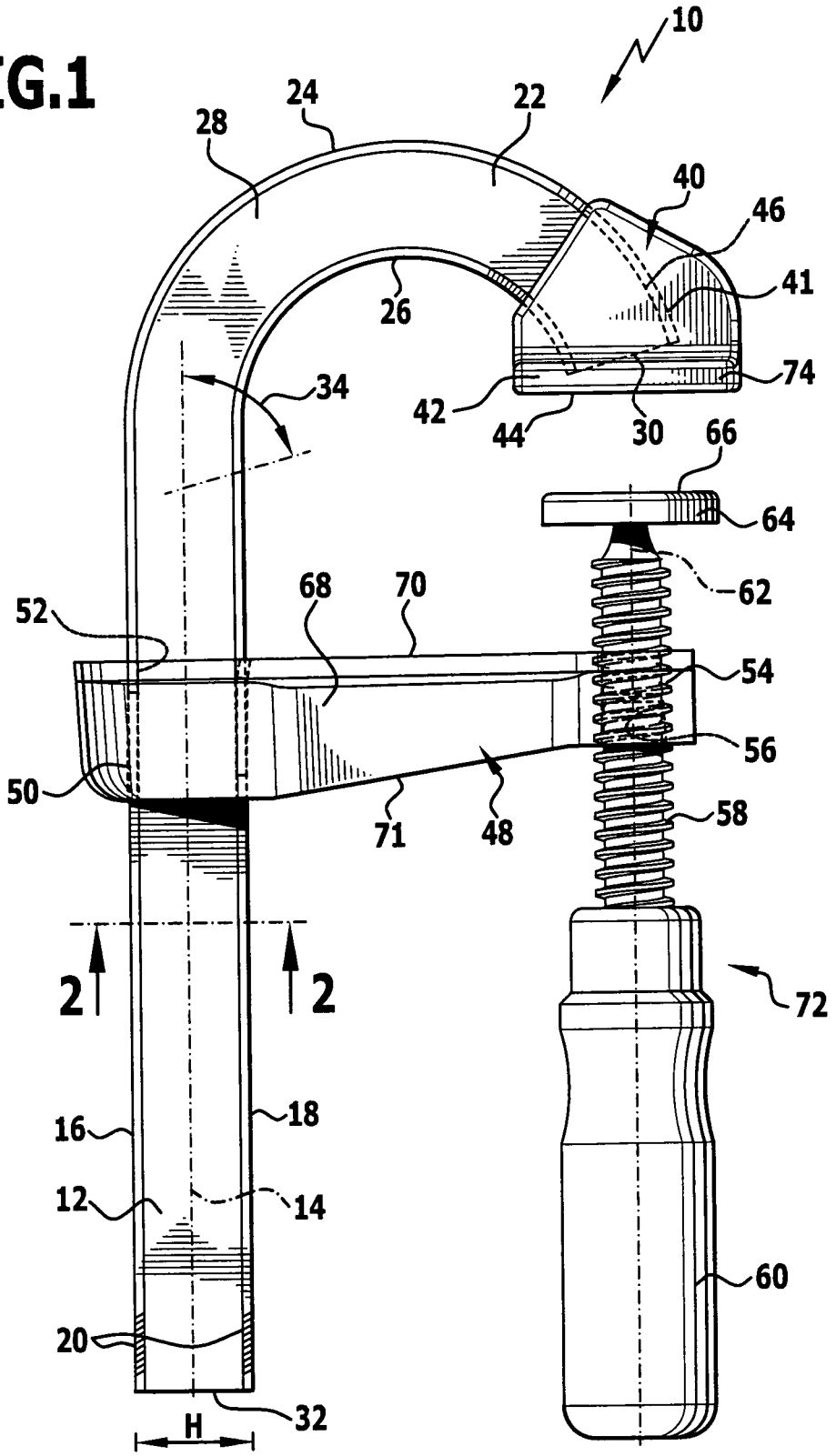
FIG. 1 shows a first embodiment of a clamp according to the invention.

An embodiment of a clamp according to the invention, which is shown in FIG. 1 and designated 10 therein, is a screw clamp. The screw clamp 10 comprises a slide rail 12. The slide rail 12 is manufactured from a metallic material such as, for example, steel. It extends in a straight line in a longitudinal direction 14. An outer side (top side) 16 and an inner side (bottom side) 18 of the slide rail 12 extend parallel to each other and parallel to the longitudinal direction 14.

The outer side 16 faces away from a clamping device which will be described in more detail hereinbelow. The inner side 18 faces this clamping device.

The slide rail 12 is profiled. It has a corrugated formation 20, for example, in the region of the outer side 16 and/or in the region of the inner side 18. Such a corrugated formation is not absolutely necessary for the functionality of the clamp 10. Upon the exertion of force, a slide arm can be tilted on the slide rail 12 and thereby fixed on the slide rail 12. The corrugated formation 20 increases the coefficient of friction for self-retention of the slide arm on the slide rail 12.

Integrally connected to the slide rail 12 (formed in one piece thereon) is a fixed arm 22 which acts upon a workpiece during the clamping. The fixed arm 22 is a cantilever arm on the slide rail 12. This fixed arm 22 projects transversely beyond the outer side 16 and the inner side 18 of the slide rail 12. The fixed arm 22 itself has a convex outer side 24, which passes tangentially into the outer side 16 of the slide rail 12. The fixed arm 22 also has a concave inner side 26, which passes tangentially into the inner side 18 of the slide rail 12.

The fixed arm 22 is manufactured by bending on the slide rail 12. A profiled preliminary element consisting of slide rail and fixed arm, which is straight, is bent in a bending machine in order to produce the fixed arm 22 with the convex outer side 24 and the concave inner side 26.

The fixed arm 22 comprises, for example, a circular ring segment 28. Other curved shapes are also possible.

In the embodiment shown, the fixed arm 22 has a front end 30. This has the same profile cross section as a front end 32 of the slide rail 12 (FIG. 1). The front end 30 of the fixed arm 22 is orientated at an angle to the longitudinal direction 14 of the slide rail 12, which is, for example, in the order of magnitude of 70°. This angle is indicated by reference numeral 34 in FIG. 1.

If the fixed arm 22 has the shape of a ring segment, the angle 34 then corresponds substantially to the angular area over which the fixed arm 22 extends.

Figure 2:
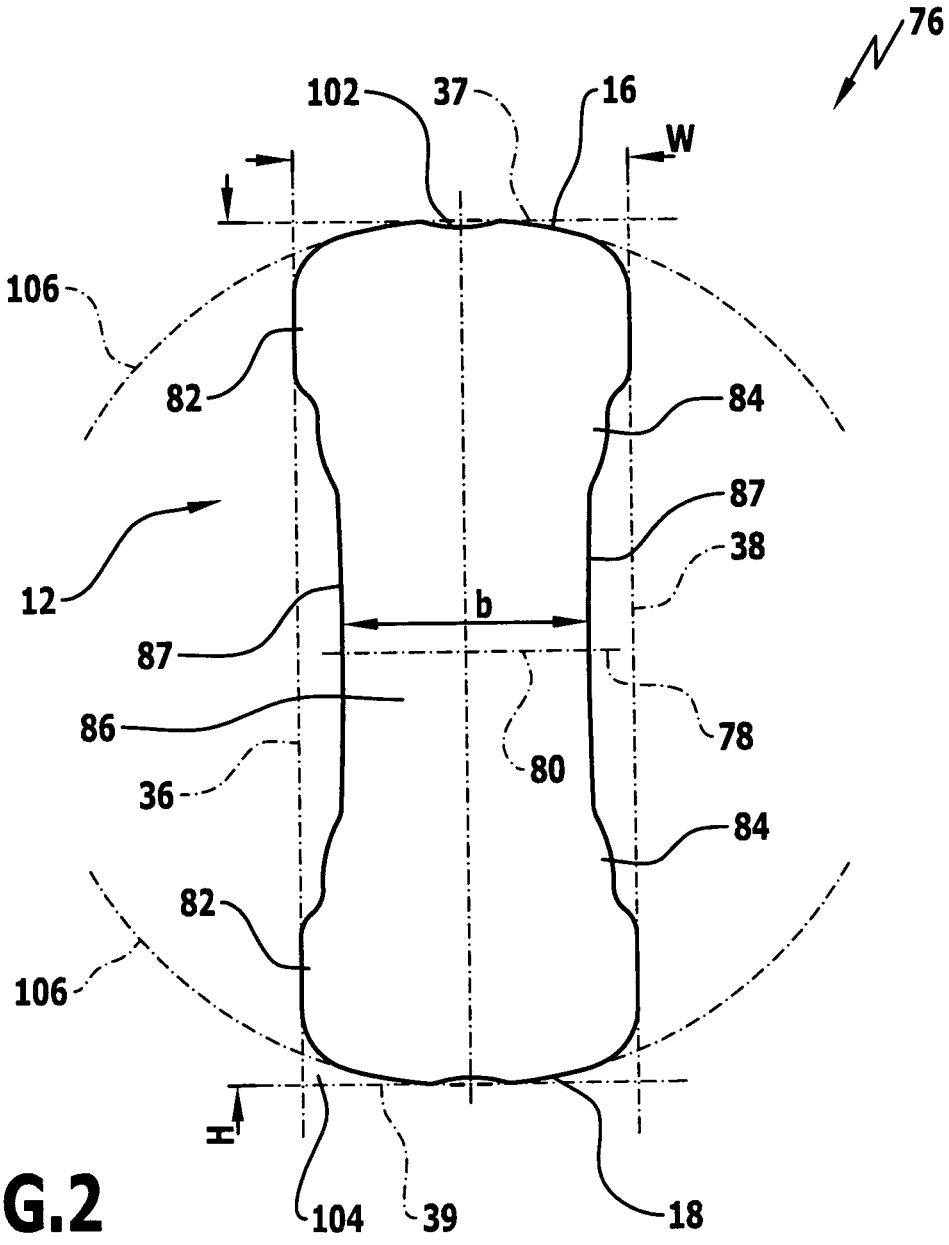
FIG. 2 shows a cross section through a slide rail of the clamp according to FIG. 1 and along line 2-2.

The slide rail 12 has a first enveloping plane 36 and a second enveloping plane 38 lying transversely to the outer side 16 and to the inner side 18 (FIG. 2). The two enveloping planes 36 and 38 are substantially parallel to each other. The outer side 16 and the inner side 18 have enveloping planes 37 and 39, which lie transversely and, in particular, vertically in relation to the enveloping plane 36 and the enveloping plane 38.

A corresponding enveloping plane of the fixed arm 22 coincides with the first enveloping plane 36, and a corresponding enveloping plane of the fixed arm 22 coincides with the second enveloping plane 38 of the slide rail 12.

The combination of profiled slide rail 12 and fixed arm 22 integrally joined thereto is produced by, for example, cold forming a metallic material and, in particular, by cold drawing or cold rolling.

For example, the combination of slide rail 12 and fixed arm 22 is produced with its profile by cold drawing or cold rolling from an endless band material prior to the bending of the fixed arm 22. The material of this combination is work-hardened. The fixed arm 22 is then produced with its convex outer side 24 and its concave inner side 26 on the slide rail 12 by bending prior to or after the cutting-to-size. The curvature is so selected that a "cold" bending is possible on a bending machine without heating the material.

On a fixing region 40 of the fixed arm 22 there is seated a pressure plate 42, which is held via a fixing region 41 of the pressure plate 42 on the fixing region 40 of the fixed arm 22. The fixing region 40 is delimited by the end 30 of the fixed arm 22.

The pressure plate 42 has an abutment surface 44 for a workpiece. This abutment surface 44 is coherent. It may also consist of several parts. It is orientated transversely and, in particular, at least approximately vertically to the longitudinal direction 14 (and hence to the slide rail 12).

The pressure plate 42 is an element that is separate from the fixed arm 22 and is subsequently fixed thereto. The fixing is carried out in such a way that no heating of the fixed arm 22 is required. Such a heating can cause a change in the microstructure of the fixed arm 22 (and the slide rail 12) manufactured by word hardening.

The pressure plate 42 can be manufactured from a metallic material or, for example, from a plastics material.

The pressure plate 42 is fixed with force locking and/or with positive locking to the fixed arm 22.

In an embodiment, the pressure plate 42 comprises a receiving space 46 on the fixing region 41, with which it is placed (and, in particular, pressed) onto the fixing region 40 of the fixed arm 22 and is fitted by pressing onto the latter in a manner secured against loss.

The pressure plate 42 is, in particular, cap-shaped, and it can be fitted with the receiving space 46 on the fixed arm 22 during the manufacture of the screw clamp 10.

There are also further possibilities for fixing the pressure plate 42 on the fixed arm 22. For example, it is fixed with positive locking on the fixed arm 22 by snap-in locking or by securing with pins or screws or by injection molding.

A slide arm 48 is arranged on the slide rail 12. The slide arm 48 comprises a slide region 50 with a cutout 52. The slide rail 12 penetrates the cutout 52.

The slide arm 48 further comprises a threaded region 54. The threaded region 54 comprises an internal thread 56, on which a clamping screw 58 (spindle 58) is guided. The clamping screw 58 is held on a grip element 60. The grip element 60 is designed for holding with one hand.

The clamping screw 58 is rotated about an axis of rotation 62 by turning the grip element 60. In accordance with the direction of rotation, a counter pressure plate 64 seated at a front end of the clamping screw is either moved towards or away from the pressure plate 42.

The counter pressure plate 64 comprises an abutment surface 66 for a workpiece, which is orientated transversely and, in particular, substantially vertically to the slide rail 12 (in its longitudinal direction 14). In particular, the abutment surface 66 is aligned or alignable substantially parallel to the abutment surface 44 of the pressure plate 42.

In a certain area thereof, the counter pressure plate 64 can be mounted for pivotal movement on the clamping screw 58. A kind of spherical mounting can, for example, be provided therefor.

The slide arm 48 further comprises a bridge region 68 between the slide region 50 and the threaded region 54. The bridge region 68 together with the slide region 50 and the threaded region 54 comprises a, for example, planar, side 70, which faces the fixed arm 22 and is orientated at least approximately vertically to the slide rail 12. Facing away from the side 70, the bridge region 68 comprises a side 71, which is orientated at an angle in, for example, the order of magnitude of approximately 170° to the slide rail 12 (to its longitudinal direction 14).

The cutout 52 of the slide arm 48 is of such dimensions that the slide arm 48 can tilt on the slide rail 12 (optionally having the corrugated formation 20) and thereby be fixed by "self-retention" on the slide rail 12. As a result, one or more workpieces can then be clamped between the pressure plate 42 and the counter pressure plate 64 by tightening the clamping screw 58.

The axis of rotation 62 impinges on the abutment surface 44 of the pressure plate 42.

The clamp 10 can be manufactured in a simple way. The fixed arm 22, which is curved, is integrally arranged on the slide rail 12. The correspondingly profiled preliminary element can be manufactured in a simple way by cold forming, and the fixed arm 22 is produced by bending. No subsequent joining of a fixed arm to the slide rail 12 is carried out. In principle, a joint area is a critical area when subjected to load. Such a critical area is avoided with the solution according to the invention.

The abutment surface 44 for one or more workpieces is provided on the fixed arm 22 by the pressure plate 42. This is an element which is separate from the fixed arm 22 and is subsequently fixed thereto. As a result, a sufficiently large and smooth abutment surface 44 is provided, with no heating of the fixed arm 22 being required for manufacturing the abutment surface 44. Such heating can cause an undesired change in the microstructure of a cold-formed fixed arm 22.

When a workpiece is clamped between a clamping device 72, comprising the clamping screw 58 and the counter pressure plate 64, and the pressure plate 42, the pressure plate 42 has essentially only to absorb compressive forces. The fixed arm 22 formed integrally on the slide rail 12 can absorb the corresponding tensile forces and bending forces.

The clamp possesses the necessary mechanical stability accompanied by simple manufacturability.

The pressure plate 42 comprises the fixing region 41 and a, for example, widened, abutment region 74, on which the abutment surface 44 is formed. The abutment region 74 can be configured such that, in relation to a direction of width of the slide rail 12 (between the first enveloping plane 36 and the second enveloping plane 38), it has a larger width than the fixing region 41. As a result, a sufficiently large abutment surface 44 and also a coherent abutment surface 44 can be provided.

The slide rail 12 has a profile cross section 76 (FIG. 2), which is constant throughout the entire length of the slide rail 12. The fixed arm 22 has the same profile cross section 76.

The enveloping planes 36 and 38 and also 37 and 39 define a rectangle in the cross section.

The slide rail 12 is of mirror-symmetrical configuration with a first mirror plane 78, which is parallel to the enveloping planes 37 and 39 and lies vertically to the enveloping planes 36 an 38. Lying vertically to the first mirror plane 78 is a second mirror plane 80, which is parallel to the enveloping planes 36 and 38 and lies vertically to the enveloping planes 37 and 39.

The slide rail 12 has an overall height and maximum height H, which is prescribed by the distance between the enveloping planes 37 and 39. A direction of height, in which the direction H is measured, lies vertically to the longitudinal direction 14 and at least approximately vertically to the axis of rotation 62. In FIG. 1, this direction of height lies in the drawing plane.

Lying vertically to this direction of height is a direction of width. In this direction of width, the slide rail 12 has an overall width (maximum width) W.

This is defined by the distance between the enveloping planes 36 and 38. The direction of width lies vertically to the longitudinal direction 14 of the slide rail 12 and at least approximately vertically to the axis of rotation 62. In FIG. 1, it lies vertically to the drawing plane.

The ratio of overall height H to overall width W is between 2.55:1 (inclusive), in particular, between 2.6:1, and 2.8:1 (inclusive). In a concrete embodiment, the ratio of overall height H to overall width W is 2.66:1.

As a result, a high rigidity of the slide rail 12 with fixed arm 22 integrally joined thereto is obtained, and the lateral rigidity is also high.

In the case of yielding workpieces, a flat decline in the clamping force occurs. In spite of the relatively large overall height of the slide rail 12, bending stresses resulting at the combination of slide rail 12 and fixed arm 22 from the prevailing loads remain below the admissible values. The overall width of the profile cross section 76 is relatively large, which results in optimized handling. The slide rail 12 does not rotate so easily in one's hand.

It has also been found that use of the aforementioned ratio or ratio range in the manufacture of the slide rail 12 with a fixed arm 22 integrally joined thereto by bending enables the combination of slide rail and fixed arm to be produced with smallest possible inner radius with an angle of 90° or more, without buckling occurring.

An optimized exploitation of the material is also obtained with the aforementioned ratio or ratio range.

Slide rails are known, wherein the ratio of overall height to overall width lies in the range of between 3:1 and 4:1. A high "height rigidity" is thereby obtained, but a disadvantage of this ratio is that the lateral rigidity is low. In addition, a steep decline in the clamping force occurs with yielding workpieces.

Slide rails are also known, wherein the ratio of overall height to overall width lies between 2:1 and 2.2:1. A high flexibility with high lateral rigidity is thereby obtained. The decline in clamping force is flat in the case of yielding workpieces. However, owing to the relatively low overall height, heavy sagging is possible. As a result, there is a tendency for a pressure plate to lift off. It may possibly slip off. A strongly inclined position of the clamping screw 58 may also occur. As a result, the friction is increased, which results in a decline in the clamping force achievable.

A more strongly inclined position of the clamping screw 58 further reinforces the sagging of the slide rail due to extension of the lever acting thereon. Moreover, exploitation of the material is not optimal, as the required lateral rigidity is "over set".

In the solution according to the invention, in which the ratio of H to W is between 2.55:1 and 2.8:1, the advantages of the known clamps are combined, and the aforementioned disadvantages are avoided or considerably reduced.

The profile cross section 76 has a first region 82 at which the maximum width W lies. The first region 82 is followed in the direction of height by a second region 84, which is then followed by a third region 86. A minimum width of the profile cross section 76 lies in the third region 86. The second region 84 is a transitional region, in which the profile cross section 76 of the slide rail 12 has a width lying between the maximum width W and the minimum width in the third region 86. Via the second region 84, a kind of "rounded-off", step-shaped transition occurs from the first region 82 to the third region 86.

Owing to the mirror symmetry of the profile cross section 76, the regions 82, 84 and 86 are of mirror-symmetrical configuration.

The slide rail 12 is of waisted configuration in the profile cross section 76. The third region 86 is a waist region.

In the waist region 86, the slide rail 12 has a surface 87, which is substantially planar and is preferably substantially parallel to the direction of height. As a result, this region can be provided in a simple way with information such as, for example, product data. In particular, this region can be printed on in a simple way.

Taking into consideration the mirror symmetry of the slide rail 12 in the profile cross section 76, the first region 82 takes up at most 50% of the overall height H. In a concrete embodiment, the first region 82 takes up approximately 35% of the overall height H.

The second region 84 preferably takes up at most 20% of the overall height H.

Compared with the first region 82, the third region 86 is set back in the direction of width. A minimum width b of the slide rail 12 in the profile cross section 76, which lies in the third region 86, is between approximately 65% and 85% of the overall width W of the slide rail 12. In a concrete embodiment, it is approximately 75% of the overall width W.

At each of the sides 16 and 18, the slide rail 12 has a hollow 102.

The slide rail 12 is rounded-off at edges 104. As a result, the slide rail 12 in the profile cross section 76 is set back at corner regions in relation to the enveloping planes 36, 37, 38, 39.

In a preferred embodiment, the slide rail 12 is rounded-off at both the outer side 16 and the inner side 18. An enveloping surface 106 of the slide rail 12 is a cylinder. An envelope (enveloping curve) in the profile cross section 76 is a circle. The corresponding circle preferably has a radius which corresponds to the overall height H. The enveloping surface cylinders 106 therefore have H as radius.

Figure 3:
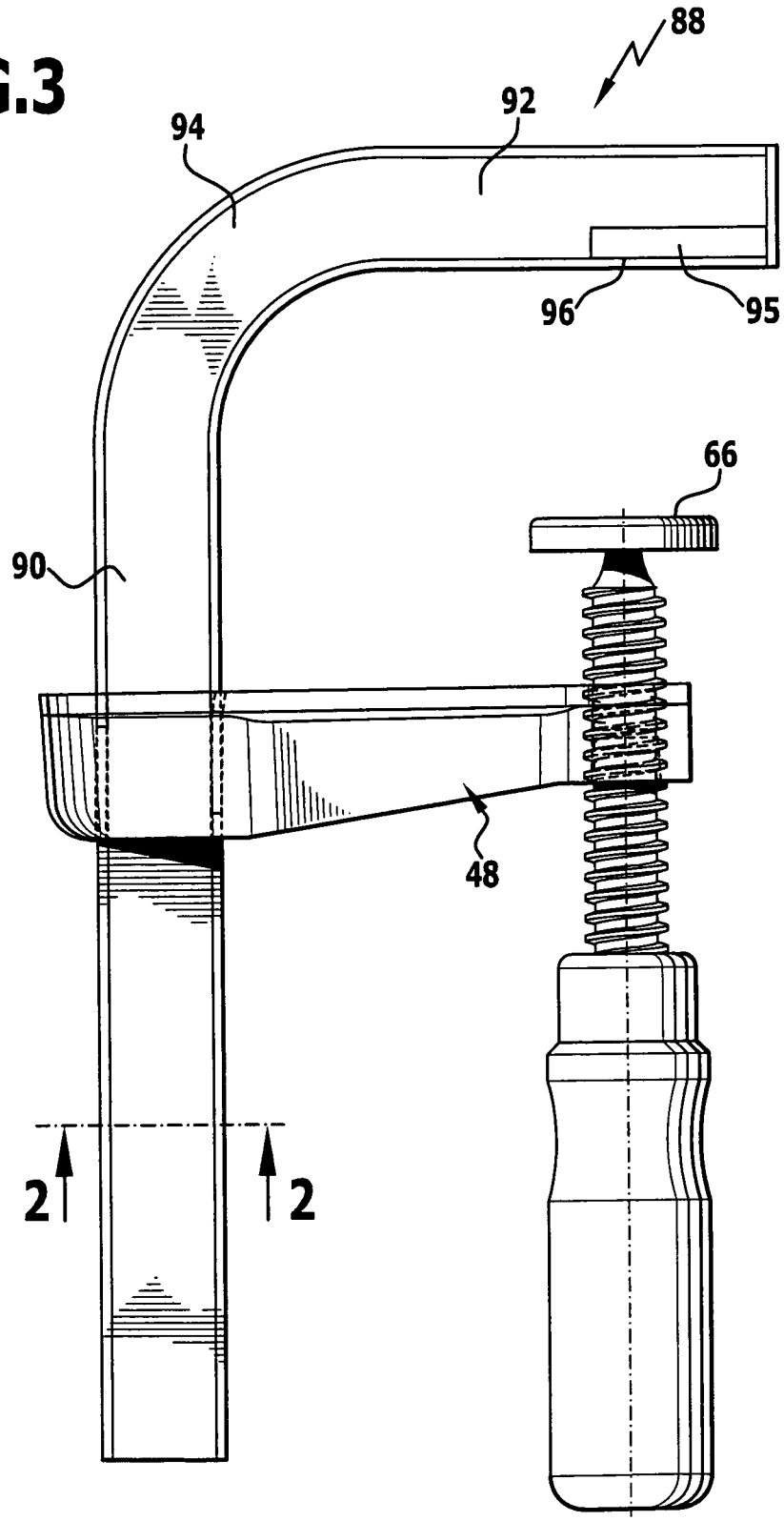
FIG. 3 shows a second embodiment of a clamp according to the invention.

A second embodiment of a clamp (an, in particular, screw clamp) according to the invention, which is shown in FIG. 3 and designated 88 therein, comprises a slide rail 90. The slide rail 90 has the same profile cross section 76 as the slide rail 12. There is slidingly arranged on the slide rail 90 a slide arm, which is identical in configuration to the slide arm 48. The corresponding reference numeral 48 will, therefore, be used therefor.

There is integrally formed on the slide rail 90 a fixed arm (cantilever arm) 92. This is joined via a transitional region 94 to the slide rail. It is manufactured by bending a combination of slide rail and fixed arm. The fixed arm 92 is orientated transversely and, in particular, vertically to the slide rail 90. Owing to the transitional region 94, a "change of direction" occurs through at least approximately 90°. The transitional region 94 is, in particular, at least approximately a quadrant ring segment.

The fixed arm 92 provides an abutment surface 96 for a workpiece, which is directed towards the abutment surface 66. The abutment surface 96 is, for example, formed in one piece on the fixed arm 92, or a corresponding element is placed on the fixed arm 92.

There is formed on the fixed arm 92 an abutment element 95, on which the abutment surface 96 is formed. This abutment element 95 is integrally formed on the fixed arm 92. It is produced by, for example, hot forming or cold forming.

In other respects, clamp 88 functions like clamp 10.

The invention claimed is:

1. Clamp, comprising:

a slide rail;

a fixed arm integrally joined to the slide rail; and a slide arm movable on the slide rail;

wherein:

the slide rail has in a cross section an overall height and an overall width having a ratio to each other of at least 2.6:1 and not greater than 2.8:1;

the slide rail is waisted in the cross section and has a first region, at which the slide rail has a maximum width in the cross section, a second region, which follows the first region, and a third region, which is a waist region, and in which the slide rail has a minimum width in the cross section, the second region being an intermediate region whose width is between the maximum width and the minimum width;

the slide rail has a constant profile cross section throughout a length of the slide rail, an end of the slide rail having an identical profile cross-section as an end of the fixed arm;

the waist region has a planar surface;

an enveloping surface of the slide rail at an outer side and/or an inner side is a cylinder; and a radius of the cylinder is the overall height.

2. Clamp in accordance with claim 1, wherein the fixed arm has, at least at an area of transition to the slide rail, a profile which is identical to a profile of the slide rail.

3. Clamp in accordance with claim 1, wherein the ratio of overall height to overall width refers to a maximum height and a maximum width in the cross section of the slide rail.

4. Clamp in accordance with claim 3, wherein the maximum height and the maximum width are defined by enveloping planes of the slide rail.

5. Clamp in accordance with claim 1, wherein the slide rail is of mirror-symmetrical configuration in the cross section.

6. Clamp in accordance with claim 5, wherein the slide rail has a first minor plane and a second mirror plane lying vertically thereto.

7. Clamp in accordance with claim 1, wherein enveloping planes of the slide rail form a rectangle in the cross section of the slide rail.

8. Clamp in accordance with claim 1, wherein the slide rail is rounded-off at edges.

9. Clamp in accordance with claim 1, wherein the slide rail has a hollow at both an outer side and an inner side.

10. Clamp in accordance with claim 1, wherein a region of the slide rail, at which the slide rail has a maximum width in the cross section, takes up at most 50% of the overall height of the slide rail in the cross section.

11. Clamp in accordance with claim 1, wherein a minimum width of the slide rail is between 65% and 85% of the overall width of the slide rail.

12. Clamp in accordance with claim 1, wherein a pressure plate is arranged on the fixed arm, the pressure plate being a separate part from the fixed arm and being fixed with at least one of positive locking and force locking on the fixed arm.

13. Clamp in accordance with claim 12, wherein the pressure plate is fixed by means of pressing to the fixed arm.

14. Clamp in accordance with claim 12, wherein the pressure plate is fixed to the fixed arm by one of snap-in locking, by securing with pins or screws, or by injection molding.

15. Clamp in accordance with claim 12, wherein the pressure plate is fixed to the fixed arm by a process which does not require any heating of the fixed arm that changes the microstructure thereof.

16. Clamp in accordance with claim 1, wherein the fixed arm is produced on the slide rail by bending.

17. Clamp in accordance with claim 1, wherein the fixed arm has a convexly curved outer side and a concavely curved inner side.

18. Clamp in accordance with claim 17, wherein the outer side and the inner side are parallel to each other.

19. Clamp in accordance with claim 17, wherein the convexly curved outer side of the fixed arm passes tangentially into the slide rail.

20. Clamp in accordance with claim 17, wherein the concavely curved inner side of the fixed arm passes tangentially into the slide rail.

21. Clamp in accordance with claim 17, wherein the fixed arm has at least one region having a shape of a ring segment.

22. Clamp in accordance with claim 1, wherein the slide rail is straight.

23. Clamp in accordance with claim 1, wherein the combination of slide rail and fixed arm is manufactured by cold forming.

24. Clamp in accordance with claim 1, wherein a first enveloping plane of the slide rail and an enveloping plane of the fixed arm coincide.

25. Clamp in accordance with claim 1, wherein an enveloping plane of the fixed arm and a second enveloping plane of the slide rail coincide.

26. Clamp in accordance with claim 1, wherein a clamping device is seated on the slide arm, the clamping device being directed with a counter pressure plate towards a pressure plate on the fixed arm.

27. Clamp in accordance with claim 26, wherein the pressure plate and the counter pressure plate have substantially parallel abutment surfaces for a workpiece.

28. Clamp in accordance with claim 26, wherein the clamping device comprises a clamping screw which is guided on a thread of the slide arm.

29. Clamp in accordance with claim 1, wherein the combination of slide rail and fixed arm is manufactured from a metallic material.

30. Clamp in accordance with claim 1, wherein at least one abutment element is formed on the fixed arm.

* * * * *